US007124966B2

(12) United States Patent
Schlairet

(10) Patent No.: US 7,124,966 B2
(45) Date of Patent: Oct. 24, 2006

(54) FUEL INJECTOR CHECK VALVE

(75) Inventor: Edward A. Schlairet, Naples, FL (US)

(73) Assignee: Haynes Corporation, Naples, FL (US)

( * ) Notice: Subject to any disclaimer, the term of this patent is extended or adjusted under 35 U.S.C. 154(b) by 90 days.

(21) Appl. No.: 10/858,686

(22) Filed: Jun. 1, 2004

(65) Prior Publication Data

US 2005/0263622 A1 Dec. 1, 2005

(51) Int. Cl.
*F02M 61/04* (2006.01)

(52) U.S. Cl. ..... 239/533.2; 239/88; 239/102.2; 239/533.3; 239/569; 239/900

(58) Field of Classification Search ..... 239/88–92, 239/95, 96, 533.2, 533.3, 533.4, 569, 585.1, 239/900, 102.2; 137/533.31, 543.21; 251/356
See application file for complete search history.

(56) References Cited

U.S. PATENT DOCUMENTS 3,249,308 A * 5/1966 Cadiou ..... 239/453
3,379,374 A * 4/1968 Mekkes ..... 239/90
3,403,632 A * 10/1968 Hulsing ..... 417/458
5,251,871 A * 10/1993 Suzuki ..... 251/127
5,328,094 A 7/1994 Goetzke
5,797,427 A 8/1998 Buescher
6,817,546 B1 * 11/2004 Battistini et al. ..... 239/533.12
6,881,331 B1 * 4/2005 Barnes ..... 210/192

* cited by examiner

*Primary Examiner*—Justine R. Yu
*Assistant Examiner*—Jason Boeckmann
(74) *Attorney, Agent, or Firm*—Porter, Wright, Morris & Arthur, LLP

(57) ABSTRACT

A high pressure unit fuel injector includes a member with a fuel delivery opening to be intermittently supplied with high pressure fuel and a valve seat encircling the fuel delivery opening. A valve cage includes a check-valve chamber adjacent the valve seat. The chamber includes an annular ledge facing the valve seat and an inwardly facing wall surrounding the ledge. A disk is located within the chamber and has opposite first and second faces alternately seatable against the valve seat and the ledge respectively. The disk has a plurality of openings between the first and second faces and a circular-shaped groove formed in the first face about a center of the disk. The groove intersects the plurality of openings.

21 Claims, 4 Drawing Sheets

FUEL INJECTOR CHECK VALVE

CROSS-REFERENCE TO RELATED APPLICATIONS

Not Applicable

STATEMENT REGARDING FEDERALLY SPONSORED RESEARCH

Not Applicable

REFERENCE TO MICROFICHE APPENDIX

Not Applicable

FIELD OF THE INVENTION

The present invention generally relates to check valves used in fuel injectors and, more particularly, to check valves used in high pressure unit fuel injectors for diesel engines.

BACKGROUND OF THE INVENTION

Fuel injectors typically use a check valve in the fuel path between an injector pumping element and an injector nozzle element. The check valve is designed to prevent a back flow of fuel into the pumping element once the delivery of fuel is complete. The check valve also prevents combustion gases from entering the pumping element in the event such gasses pass through valve associated with the nozzle element.

In engines with high ratings, flow irregularities often referred to as knocking has occurred in some injectors during high output operation. This knocking is believed to be due to unstable motion of the check valve disk during the pumping stroke when the disk should be seated on a ledge spaced from the valve seat. It is believed that rapid radial outflow of fuel over the upper side of the disc to passages through the disk, typically in the form of scallops at edges of the disk, causes momentary reductions in pressure above the disk sufficient to allow system pressure below the disk to lift it erratically from the ledge. In an effort to reduce knocking, attempts have been made to reduce the radial flow path of fuel over the top surface of the check valve disk.

U.S. Pat. No. 5,328,094, the disclosure of which is expressly incorporated herein in its entirety by reference, discloses a fuel injector check valve having a plurality of equally spaced holes. The plurality of holes are equally spaced in a ring near the fuel delivery opening.

U.S. Pat. No. 5,797,427, the disclosure of which is expressly incorporated herein in its entirety by reference, discloses a fuel injector check valve having a plurality of notches or slots. The notches or slots have inner edges that are concave in shape and are located near the fuel delivery opening to reduce the radial distance between the fuel delivery opening and the notches.

While these prior attempts may have somewhat reduced flow irregularities, they have reduced the seal area and require relatively large loads to open. Accordingly, three is a need in the art for an improved fuel injector check valve.

SUMMARY OF THE INVENTION

The present invention provides a fuel injector check valve which overcomes at least some of the above-noted problems of the related art. According to the present invention, a high pressure unit fuel injector includes, in combination, a member with a fuel delivery opening to be intermittently supplied with high pressure fuel and a valve seat encircling the fuel delivery opening. A valve cage includes a check-valve chamber adjacent the valve seat. The check-valve chamber includes an annular ledge facing the valve seat and an inwardly facing wall surrounding the ledge. A disk is located within the check-valve chamber and has opposite first and second faces alternately seatable against the valve seat and the ledge respectively. The disk has an outer edge in opposed relation to the wall and having limited radial clearance therefrom when centered in the check-valve chamber. The disk has a plurality of openings between the first and second faces and a groove formed in the first face.

According to another aspect of the present invention, a high pressure unit fuel injector comprises, in combination a member with a fuel delivery opening to be intermittently supplied with high pressure fuel and a valve seat encircling the fuel delivery opening. A valve cage includes a check-valve chamber adjacent to the valve seat. The check-valve chamber includes an annular ledge facing the valve seat and an inwardly facing wall surrounding the ledge. A disk is located within the check-valve chamber and has opposite first and second faces alternately seatable against the valve seat and the ledge respectively. The disk has an outer edge in opposed relation to the wall and having limited radial clearance therefrom when centered in the check-valve chamber. The disk has a plurality of openings between the first and second faces and a circular-shaped groove formed in the first face about a center of the disk. The groove intersects the plurality of openings and is located radially outward of the fuel delivery opening.

From the foregoing disclosure and the following more detailed description of various preferred embodiments it will be apparent to those skilled in the art that the present invention provides a significant advance in the technology of fuel injector check valves. Particularly significant in this regard is the potential the invention affords for providing a high quality, reliable assembly with improved operational performance. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
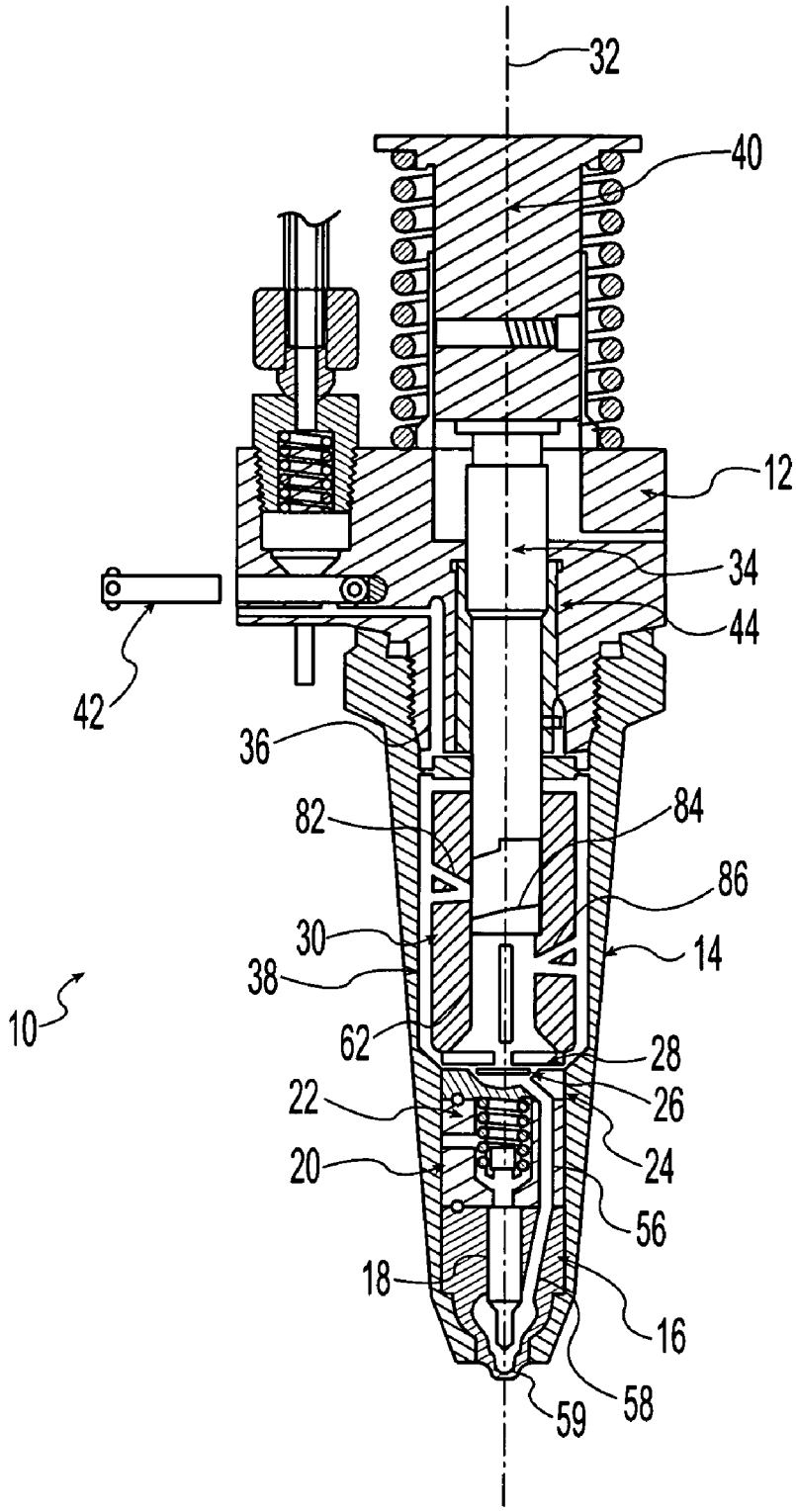
FIG. 1 is a cross-sectional view of one type of unit fuel injector for EMD diesel engines and incorporating a check valve according to the present invention.

It should be understood that the appended drawings are not necessarily to scale, presenting a somewhat simplified representation of various preferred features illustrative of the basic principles of the invention. The specific design features of the fuel injector check valve as disclosed herein, including, for example, specific dimensions, orientations, and shapes of the openings and grooves will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the fuel injector check valve illustrated in the drawings. In general, up or upward refers to an upward direction within the plane of the paper in FIG. 1 and down or downward refers to a downward direction within the plane of the paper in FIG. 1.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved fuel injector check valve disclosed herein. The following detailed discussion of various alternative and preferred embodiments will illustrate the general principles of the invention with reference to a fuel injector of the high pressure, unit fuel injection type and, more particularly, a fuel injector intended for use in engines manufactured by Electro-Motive Division (EMD) of General Motors. It is noted, however, that other high pressure direct injection fuel injectors for diesel fuel and other liquid and semi-liquid fuels are within the scope of the present invention. Other embodiments suitable for other applications will be apparent to those skilled in the art given the benefit of this disclosure.

Referring now to the drawings, FIG. 1 shows a fuel injector 10 according to the present invention. The fuel injector 10 includes a main housing 12 and a housing nut 14 threaded to a threaded lower extension of the main housing 12. When installed with an engine, the housing nut 14 extends from the main housing 12, which is at the exterior of the engine, through the engine wall to the combustion chamber. The housing nut 14 is clamped to the engine wall in a well-known manner. The housing nut 14 houses main injector components described below and threadedly clamps them with the main housing 12 in their stacked relationship in a well-known manner.

Clamped main injector components include a spray tip 16 carrying a nozzle valve 18, a spring cage 20 carrying a valve spring 22, a check-valve cage 24 carrying a check valve disk 26, a spacer or body 28, and a bushing 30. The bushing 30 forms a vertically extending central passage at the central axis 32 of the fuel injector 10 which receives a reciprocable plunger 34. Passages 36, 38 in the main body and the bushing supply fuel to the central passage for pumping under high pressure by the plunger 34. A follower 40 engages the upper end of the plunger 34 for downwardly actuating the plunger 34 in response to the engagement of a cam.

The amount and timing of fuel injected each cycle is mechanically controlled in a known manner. A rack 42 engages a gear 44 secured to the plunger 34 to selectively rotate the plunger 34 within the bushing 30 to vary the length of the pumping stroke. It is noted that other known means for mechanically or electronically controlling the fuel rate and timing can alternatively be utilized.

Figure 2:
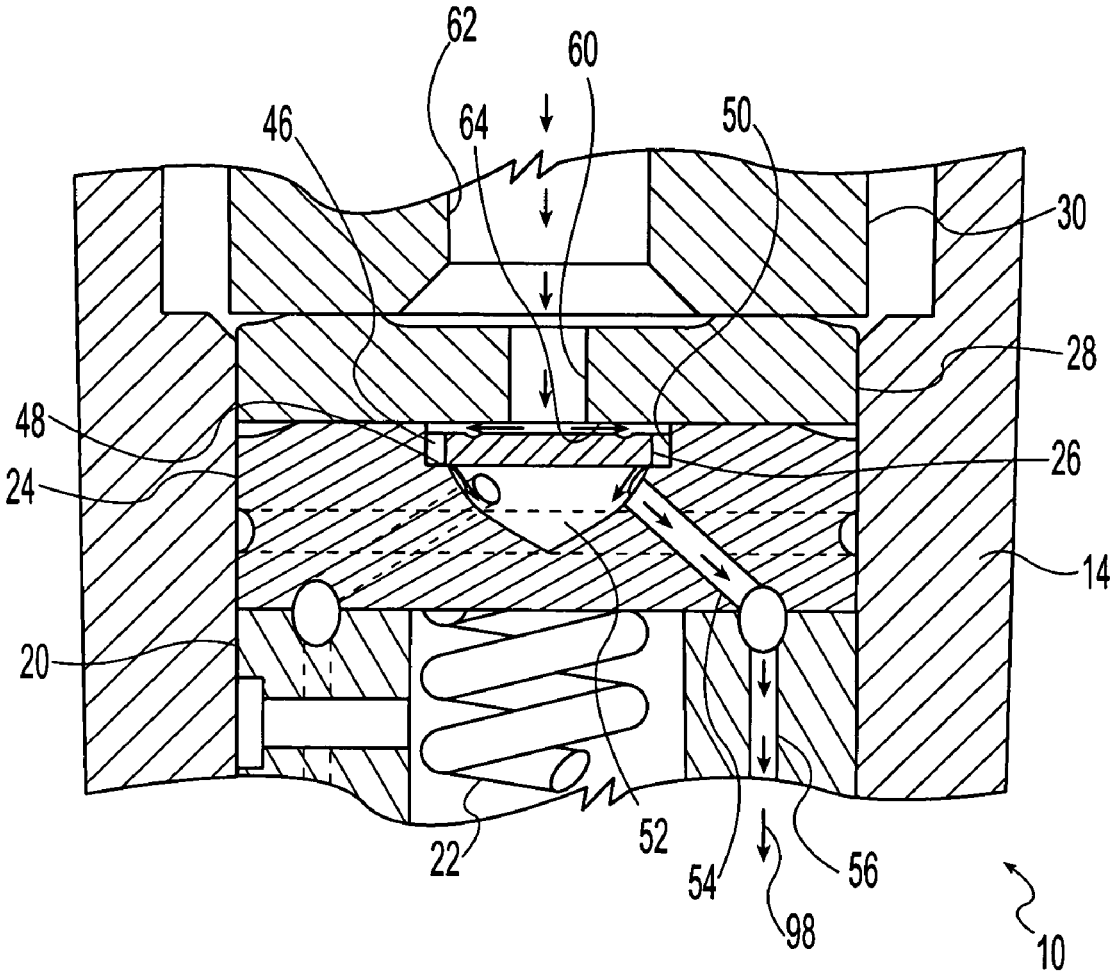
FIG. 2 is an enlarged, fragmented view of a portion of the fuel injector of FIG. 1 showing the check valve in a valve open position.

As best shown in FIG. 2, the check valve cage 24 has a flat upper surface with a check-valve chamber or recess 46 downwardly formed therein and coaxial with the central axis 32. An annular shaped shoulder or ledge 48 is parallel to and spaced below the upper surface and a cylindrically shaped wall 50 extends between the upper surface and the ledge 48. A delivery chamber 52 downwardly extends inward of the ledge 48. A plurality of delivery passages 54 downwardly extend from the delivery chamber 52 to connecting passages 56, 58 in the spring cage 20 and spray tip 16 leading to orifices or spray holes 59 in the end of the spray tip 16 and controlled by the nozzle valve 18 in a known manner.

The spacer or body 28 includes a flat lower surface which sealingly engages the upper surface of the check valve cage 24. A central fuel delivery opening or orifice 60 extending through the spacer 28 connects the pumping chamber 62 formed in the bushing 30 and bounded by the plunger 34 with the check-valve chamber 46. The lower surface of the spacer 28 forms a check valve seat 64 formed around the fuel delivery opening 60.

Figure 3:
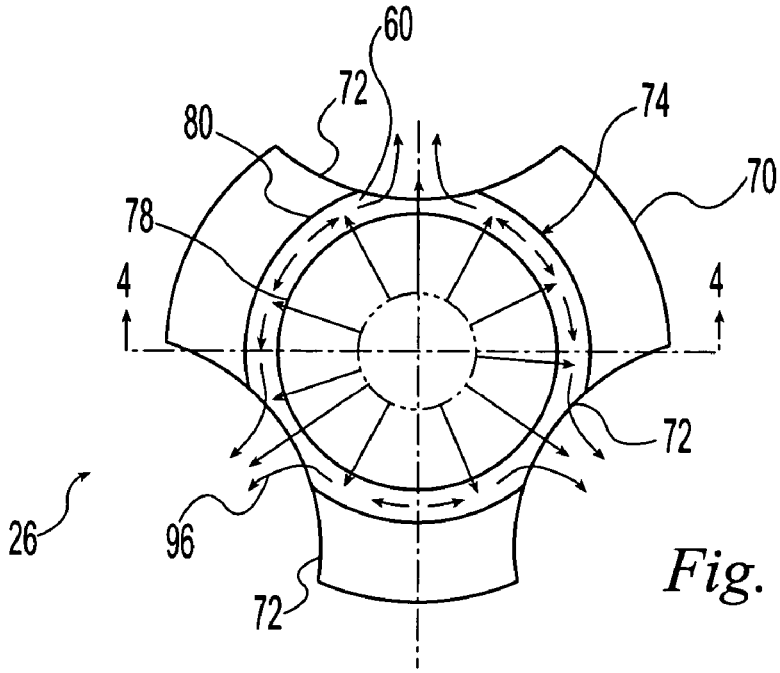
FIG. 3 is a top plan view of check valve disk of the check valve of FIGS. 1 and 2.
Figure 4:
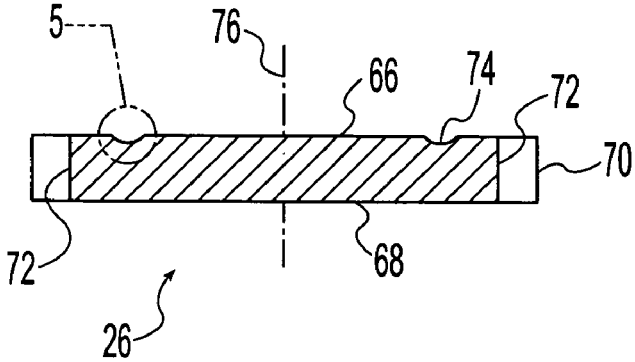
FIG. 4 is a cross-sectional view taken along line 4—4 of FIG. 3.
Figure 5:
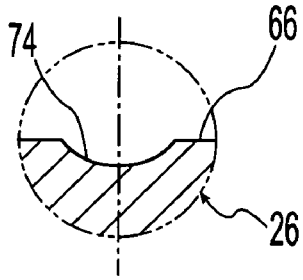
FIG. 5 is an enlarged fragmented view taken from the area of circle 5 in FIG. 4.

As best shown in FIGS. 3 to 5, the check valve disk 26 has opposed flat upper and lower surfaces 66, 68 and a circular outer edge 70 sized to be closely received within the cylindrically-shaped portion of the check-valve chamber 46 such that it alternately seats upon the ledge 48 and the valve seat 64. A plurality of passages or openings 72 extend through the disk 26 from first face 66 to the second face 68. The illustrated openings 72 are cutouts or scallops equally spaced about the circular outer edge but other suitable shapes can be utilized. The illustrated disk has three equally spaced scallops but other suitable quantities can be utilized. The openings 72 extend radially inward from the outer edge 70 a distance sufficient to provide adequate low restriction fuel flow when the disk 26 is seated on the ledge 48 of the check-valve cage 24. The total area of the openings 72 is preferably larger than the area of the fuel delivery opening 60 so that the openings 72 do not significantly restrict fuel flow into the delivery chamber 52.

Formed in the upper surface 66 of the disk 26 is an annular-shaped groove 74 coaxial with a central axis 76 of the disk 26. The illustrated groove 74 is arcuate or arched in cross-section but other suitable shapes can be utilized. The groove 74 is sized and shaped to intersect the openings 72 and provide a generally equal fuel path in a radial direction even at locations between the openings 72. The illustrated groove 74 has an inner edge 78 radially inward of the openings 72 and an outer edge 80 which intersects the openings 72. The groove 74 provides a fuel pathway along the upper surface of the disk 26 which is generally equal in each radial direction. The groove 74 is also spaced away from the fuel delivery opening 60 to provide an increased seal area.

A preferred embodiment of the check valve disk 26 for injectors of EMD engines, the disk 26 is made of alloy steel and has a thickness of about 0.047 inches and a diameter of about 0.375 inches. Three equally spaced scallops 72 have a radius of about 0.141 inches and a depth of about 0.076 inches. The groove 74 has an inner edge 78 located at a radius of about 0.107 inches, a depth of about 0.004 inches, and a cross-sectional radius of about 0.015 inches.

In operation, low pressure fuel is admitted through the supply passages to a supply or fill port 82 and into the pumping chamber 62. Rotation of the cam against the follower 40 cyclically reciprocates the plunger 34 down and up within the pumping chamber 62 to pressurize and pump controlled amounts of fuel from the pumping chamber 62. The volume of fuel is controlled by the position of the rack 42 and the gear 44 which mechanically rotate the plunger 34. When the plunger 34 covers the fill port 82, a pressure wave is generated which opens the check valve by downwardly moving the disk 26 off the valve seat 64, and travels down through the passages within the check valve cage 24, the spring cage 20, and the nozzle tip to act on the nozzle valve 18. Usually the first pressure wave is sufficient to lift the nozzle valve 18 off its seat and injection begins. If the pressure wave is insufficient to lift the nozzle valve 18, the pressure build-up which immediately follows will do so.

As the plunger 36 descends, fuel discharged from the pumping chamber 62 is passed at high pressure down through the fuel delivery opening 60, radially outward from the fuel delivery opening over the upper surface 66 of the disk 26 to the groove 74, and along the groove 74 to the openings 72 to break the seal between the check valve disk 26 and the valve seat 64. This initial flow path which break the seal is best shown in FIG. 3 by arrows 96. The opening load is provided by injection pressure acting on the top surface 66 of the disk 26 which overcomes residual pressure acting on the bottom surface of the disk 26 to hold the disk 26 up against the valve seat 64. Once this seal is broken, high pressure fuel passing through the fuel delivery opening 60 moves the check valve disk 26 downward until the disk 26 is seated against the ledge 48 in a valve open position (as best shown in FIG. 2). With the disk 26 in the valve open position, fuel passes down through the fuel delivery opening 60, over the upper surface of the disk 26 and the groove 74 to the openings 72, through the openings 72 to the delivery chamber 52, and out of the delivery chamber through the delivery passages 54 and the connecting passages 56, 58 to the nozzle valve 18. This flow path with the disk 26 down against the ledge 48 is best shown in FIG. 2 by arrows 98. From the spray tip 16, fuel is atomized and delivered to the associated engine combustion chamber by passing through the spray holes 59 as is well known. It is believed that the groove 74 serves as a drain for fuel so that the disk 26 breaks away from the valve seat 64 in an even and steady manner with less opening load than standard or prior modified valves. It is also believed that the groove 74 stabilizes the disk 26 by assisting to hold the disk 26 down in a stable and seated condition against the ledge 48 as fuel passes over the groove 74 when the disk 26 is in the valve open position.

The nozzle valve 18 stays lifted during the time fuel is being delivered by the plunger 36 to the spray tip 16. When a helix edge 84 of the plunger 36 uncovers the spill port 86, pressure above the plunger 36 drops to fuel supply pressure and the check valve disk 26 upwardly seats onto the valve seat 64 formed by the spacer 28 to close the check valve and seal the fuel delivery opening 60 leading through the spacer 28 to the check valve chamber 46. As these event s occur, pressure in the nozzle or spray tip 16 drops rapidly and the nozzle valve 18 closes and fuel injection ends when pressure in the spray tip 16 drops to the closing pressure of the nozzle valve 18. Residual pressure in the check valve chamber 46 holds the check valve disk 26 upward against the valve seat 64 closing the fuel delivery opening 60 against the return flow of fuel and maintaining a barrier against the intrusion of cylinder combustion gases into the injector passages 36, 38 and the pumping chamber 62.

Figure 6:
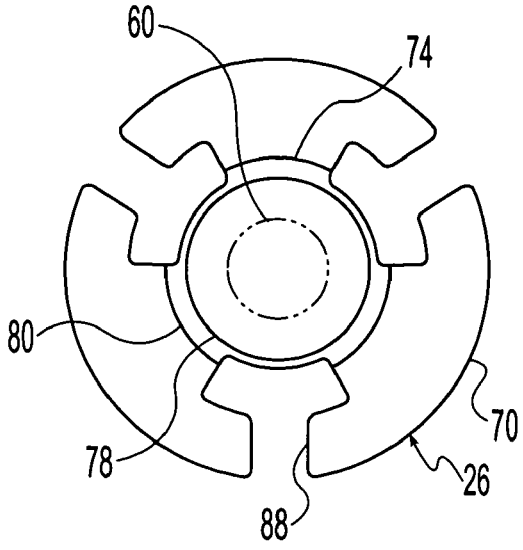
FIG. 6 is a top plan view of a first alternative embodiment of the Check valve disk of FIG. 3.
Figure 7:
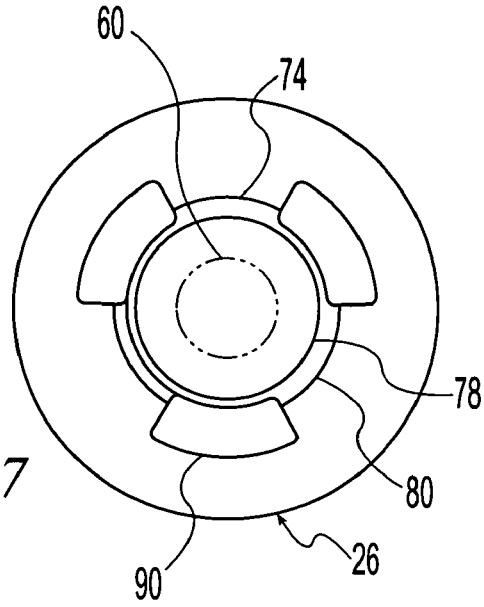
FIG. 7 is a top plan view of a second alternative embodiment of the Check valve disk of FIG. 3.
Figure 8:
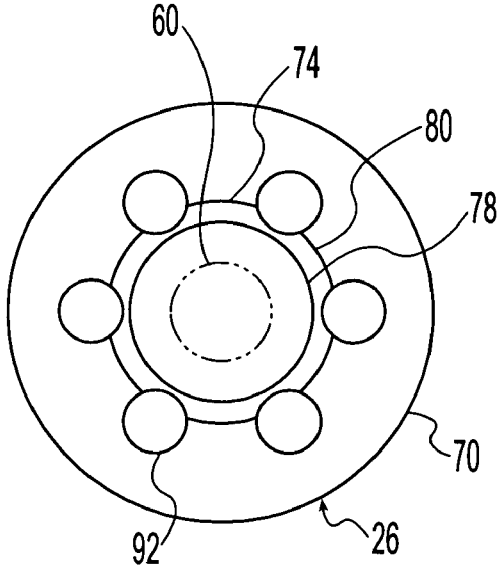
FIG. 8 is a top plan view of a third alternative embodiment of the Check valve disk of FIG. 3.
Figure 9:
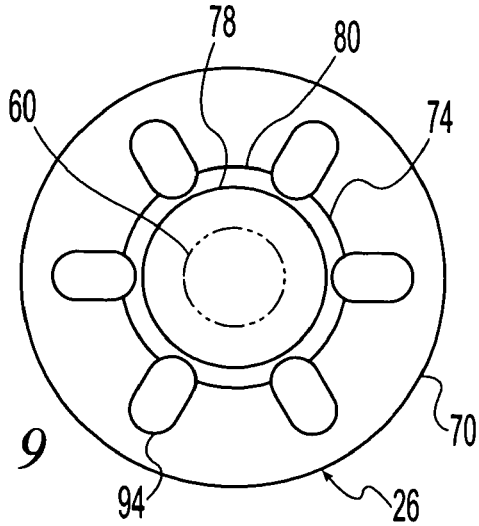
FIG. 9 is a top plan view of a fourth alternative embodiment of the Check valve disk of FIG. 3.

FIGS. 6 to 9 show alternative embodiments of the check valve disk 26 according to the present invention which show that the openings 72 can take forms other than scallops within the scope of the present invention. FIG. 6 shows the disk 26 having a plurality of notches 88 spaced apart along the outer edge 70 of the disk 26. The illustrated disk 26 has three notches 88 but other suitable quantities can be utilized. It is noted that the notches 88 can also have other suitable shapes. FIG. 7 shows the disk 26 having a plurality of spaced-apart slots 90 located wholly inward of the outer edge 70 of the disk 26. The illustrated disk 26 has three slots 90 but other suitable quantities can be utilized. It is noted that the slots 90 can also have other suitable shapes. FIG. 8 shows the disk 26 having plurality of spaced-apart circular-shaped holes 92 located wholly inward of the outer edge 70 of the disk 26. The illustrated disk 26 has six holes 92 but other suitable quantities can be utilized. FIG. 9 shows the disk having a plurality of spaced-apart oblong or oval-shaped holes 94 located wholly inward of the outer edge 70 of the disk 26. The illustrated disk 26 has six holes 94 but other suitable quantities can be utilized. It is noted that while FIGS. 6 to 9 illustrate a variety of alternatives for the openings 72, the plurality of openings 72 can have any other suitable shape and quantity.

It is apparent from the foregoing disclosure that fuel injector check valve of the present invention provides substantial performance improvements by increasing the radial flow path, compared to prior art designs, but providing a generally equal flow path in each radial direction. The performance improvements include a larger seal area, even and steady opening, and lower opening load requirements.

From the foregoing disclosure and detailed description of certain preferred embodiments, it will be apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A high pressure unit fuel injector comprising:

a member with a fuel delivery opening to be intermittently supplied with high pressure fuel and a valve seat encircling the fuel delivery opening;

a valve cage including a check-valve chamber adjacent the valve seat;

wherein the check-valve chamber includes an annular ledge facing the valve seat and an inwardly facing wall surrounding the ledge;

a check-valve disk movable within the check-valve chamber between the valve seat and the annular ledge and having opposite first and second faces alternately seatable against the valve seat and the ledge respectively;

wherein the disk has an outer edge in opposed relation to the wall and having limited radial clearance therefrom when centered in the check-valve chamber;

wherein the disk has a plurality of openings between the first and second faces for passage of fuel past the disk;

wherein the disk has a groove formed in the first face; and wherein the groove is located about the fuel delivery opening to provide a flow path from the fuel delivery opening to the plurality of openings, for even and steady movement of the disk as it breaks away form the valve seat.

2. The fuel injector according to claim 1, wherein the groove is and the openings are each located radially outward of both the fuel delivery opening and the valve seat.

3. The fuel injector according to claim 1, wherein the groove intersects the plurality of openings.

4. The fuel injector according to claim 3, wherein the groove is circular with an inner edge located radially inward of the plurality openings and an outer edge intersecting the plurality of openings.

5. The fuel injector according to claim 1, wherein at least a portion of the groove is located radially inward of the plurality of openings.

6. The fuel injector according to claim 1, wherein the groove is circular to form a generally equal flow path from the fuel delivery opening to the groove in each radial direction.

7. The fuel injector according to claim 6, wherein the circular groove is centered about a center of the disk.

8. The fuel injector according to claim 7, wherein the groove is circular with an inner edge located radially inward of the plurality of openings and an outer edge intersecting the plurality of openings.

9. A high pressure unit fuel injector comprising:

a member with a fuel delivery opening to be intermittently supplied with high pressure fuel and a valve seat encircling the fuel delivery opening;

a valve cage including a check-valve chamber adjacent the valve seat;

wherein the check-valve chamber includes an annular ledge facing the valve seat and an inwardly facing wall surrounding the ledge;

a disk within the check-valve chamber and having opposite first and second faces alternately seatable against the valve seat and the ledge respectively;

wherein the disk has an outer edge in opposed relation to the wall and having limited radial clearance therefrom when centered in the check-valve chamber;

wherein the disk has a plurality of openings between the first and second faces;

wherein the disk has a groove formed in the first face; and wherein the groove is arcuate in cross-section.

10. The fuel injector according to claim 1, wherein the first and second faces are flat except for the groove formed in the first face.

11. The fuel injector according to claim 1, wherein the plurality of openings are scallops spaced apart along the outer edge of the disk.

12. The fuel injector according to claim 1, wherein the plurality of openings are circular-shaped holes located wholly inward of the outer edge of the disk.

13. The fuel injector according to claim 1, wherein the plurality of openings are oval-shaped holes located wholly inward of the outer edge of the disk.

14. The fuel injector according to claim 1, wherein the plurality of openings are slots located wholly inward of the outer edge of the disk.

15. The fuel injector according to claim 1, wherein the plurality of openings are notches spaced apart along the outer edge of the disk.

16. A high pressure unit fuel injector comprising:

a member with a fuel delivery opening to be intermittently supplied with high pressure fuel and a valve seat encircling the fuel delivery opening;

a valve cage including a check-valve chamber adjacent the valve seat;

wherein the check-valve chamber includes an annular ledge facing the valve seat and an inwardly facing wall surrounding the ledge;

a check-valve disk movable within the check-valve chamber between the valve seat and the annular ledge and having opposite first and second faces alternately seatable against the valve seat and the ledge respectively;

wherein the disk has an outer edge in opposed relation to the wall and having limited radial clearance therefrom when centered in the check-valve chamber;

wherein the disk has a plurality of openings between the first and second faces for passage of fuel past the disk;

wherein the disk has a circular-shaped groove formed in the first face about a center of the disk;

wherein the groove intersects the plurality of openings and is located radially outward of the fuel delivery; and wherein the groove is provides a generally equal flow path from the fuel delivery opening to the plurality of openings, for even and steady movement of the disk as it breaks away form the valve seat.

17. The fuel injector according to claim 16, wherein the groove has an inner edge located radially inward of the plurality of openings and an outer edge intersecting the plurality of openings.

18. The fuel injector according to claim 16, wherein at least a portion of the groove is located radially inward of the plurality of openings.

19. A high pressure unit fuel injector comprising:

a member with a fuel delivery opening to be intermittently supplied with high pressure fuel and a valve seat encircling the fuel delivery opening;

a valve cage including a check-valve chamber adjacent the valve seat;

wherein the check-valve chamber includes an annular ledge facing the valve seat and an inwardly facing wall surrounding the ledge;

a disk within the check-valve chamber and having opposite first and second faces alternately seatable against the valve seat and the ledge respectively;

wherein the disk has an outer edge in opposed relation to the wall and having limited radial clearance therefrom when centered in the check-valve chamber;

wherein the disk has a plurality of openings between the first and second faces;

wherein the disk has a circular-shaped groove formed in the first face about a center of the disk;

wherein the groove intersects the plurality of openings and is located radially outward of the fuel delivery opening; and wherein the groove is arcuate in cross-section.

20. The fuel injector according to claim 16, wherein the plurality of openings are scallops spaced apart along the outer edge of the disk.

21. The fuel injector according to claim 16, wherein the groove and the openings are each located radially outward of both the fuel delivery opening and the valve seat.

* * * * *